US005556006A

United States Patent [19]

Sano

[11] Patent Number: 5,556,006

[45] Date of Patent: Sep. 17, 1996

[54] DRINK SUPPLY APPARATUS

[75] Inventor: Shigeki Sano, Mie, Japan

[73] Assignee: Fuji Electric Co., Ltd., Kawasaki, Japan

[21] Appl. No.: 413,209

[22] Filed: Mar. 28, 1995

[30] Foreign Application Priority Data

Apr. 5, 1994 [JP] Japan ..... 6-066334

[51] Int. Cl.[6] ..... B67D 5/56

[52] U.S. Cl. ..... 222/129.1; 222/146.6

[58] Field of Search ..... 222/129.1, 129.2, 222/129.3, 129.4, 146.6

[56] References Cited

U.S. PATENT DOCUMENTS

| | | | |
|---|---|---|---|
| 3,215,312 | 11/1965 | Guzi | 222/129.1 |
| 3,240,395 | 3/1966 | Carver | 222/129.1 |
| 3,348,737 | 10/1967 | Yingst et al. | 222/129.1 X |
| 4,304,736 | 12/1981 | McMillin et al. | 222/129.1 X |
| 4,687,120 | 8/1987 | McMillin | 222/129.1 X |
| 4,708,266 | 11/1987 | Rudick | 222/129.1 X |
| 4,979,647 | 12/1990 | Hassell | 222/129.1 X |
| 5,086,951 | 2/1992 | Nakayama et al. | 222/129.1 |
| 5,411,179 | 5/1995 | Oyler et al. | 222/129.1 |

FOREIGN PATENT DOCUMENTS

| | | |
|---|---|---|
| 0152283 | 8/1985 | European Pat. Off. . |
| 0165792 | 12/1985 | European Pat. Off. . |
| 1937206 | 2/1971 | Germany . |

*Primary Examiner*—Andres Kashnikow
*Assistant Examiner*—Kenneth Bomberg
*Attorney, Agent, or Firm*—Kanesaka & Takeuchi

[57] ABSTRACT

A drink supply apparatus is formed of first and second drink supply systems retained in a housing. The first drink supply system supplies a drink from a disposable drink container. The second drink supply system supplies a syrup and chilled water, and include a syrup supply line and a chilled water supply line. The syrup supply line supplies the syrup from a syrup tank by a gas supply device, and the chilled water supply line supplies chilled water from a water reservoir.

7 Claims, 6 Drawing Sheets

DRINK SUPPLY APPARATUS

BACKGROUND OF THE INVENTION AND RELATED ART STATEMENT

The present invention relates to a drink supply apparatus used for cup-type automatic vending machines or dispensers.

FIG. 7 is a block diagram showing a conventional drink supply system for supplying drink from a disposable container. In this figure, a disposable container 1 comprises a plastic container 2 with an outlet for a drink, e.g. oolong tea or syrup of orange juice, and a box 3 for retaining the plastic container. This drink supply system is convenient for transport and is very sanitary because it requires no cleaning when drinks are supplied thereto.

When a customer presses a button (not shown) to purchase a drink, a controller (not shown) activates a rotary pump 5 and a drink solenoid valve 6. A specified amount of a drink in the drink container 1 starts to flow through a selling switch 4 and the rotary pump 5. The drink is cooled by a drink cooling coil 26 in a water tank 12, and is then poured into a cup via the drink solenoid valve 6, a tube 7 and a nozzle 10*a*. Water in the water tank 12 is maintained at a constant temperature by a cooler (not shown).

FIG. 8 is a block diagram showing a conventional drink supply system for supplying a syrup and a diluent. In this figure, the syrup in a syrup tank 17 is ready for discharge to a nozzle under gas pressure applied thereto by carbon dioxide gas supplied from a carbon-dioxide gas cylinder 21. When a customer presses a button (not shown) to purchase a drink, a controller (not shown) activates a syrup solenoid valve 19, and the syrup is supplied to the nozzle 10*b* through a syrup cooling coil 18, a syrup solenoid valve 19 and a tube 20.

The syrup is diluted with carbonated water or chilled water depending on the type of the syrup. When the syrup is diluted with chilled water, a water pump 14 and a chilled water three-way solenoid valve 25 are activated upon receiving a syrup supply instruction to supply water from a water reservoir 13 to the nozzle 10*b* through the water pump 14, a water cooling coil 15, a chilled water three-way solenoid valve 25 and a tube 16*a*. The water is then mixed in the nozzle 10*b* with the syrup supplied almost simultaneously with the water, and the mixture is then poured into a cup 23*b*.

When the syrup is diluted with carbonated water, carbonated water stored in a carbonator 22 which has been prepared by dissipating into water carbon dioxide gas supplied from a carbon-dioxide gas cylinder 21 is ready for discharge to the nozzle under the pressure of the carbon-dioxide gas that is not dissipated into the water. Upon receiving a syrup supply instruction, a carbonated water solenoid valve 24 is activated to supply the carbonated water to the nozzle 10*b* through a tube 16*b*. The carbonated water is then mixed in the nozzle 10*b* with the syrup supplied almost simultaneously with the water, and the mixture is then poured into the cup 23*b*.

Demand for drink supply apparatuses that supply drinks from a disposable container is increasing because the disposable container is sanitary and easy to handle. Drink supply apparatuses that supply drinks from a syrup tank are still in demand, but all of these apparatuses have not been replaced with drink supply apparatuses that supply drinks from a disposable container.

A large installation space is, however, required if a drink supply apparatus housed in one vending machine that supplies drinks from a disposable container and a drink supply apparatus housed in another vending machine that supplies drinks from a syrup thank are placed side by side at the same location.

This method also requires large installation costs because the same coin mechanism, cup supply mechanism, city water tap, and cup outlet port must be provided in the respective apparatuses.

It is thus an object of the invention to house in a single vending machine a drink supply apparatus that supplies drinks from a disposable container and a drink supply apparatus that supplies drinks from a syrup tank to allow them to share a coin mechanism, cup supply mechanism, city water tap, and cup outlet port which would otherwise have to be provided in the respective apparatuses, thereby reducing the required installation space and installation costs.

It is another object of the invention to provide a drink supply apparatus capable of maintaining syrup, chilled water and carbonated water at an appropriate temperature.

SUMMARY OF THE INVENTION

In a first aspect of the invention, a drink supply apparatus houses in a single space a first drink supply system that supplies drinks and is formed of a disposable drink container, a pump for discharging a specified amount of a drink from the disposable drink container, and a drink solenoid valve; and a second drink supply system formed of a syrup supply line and a chilled water supply line. The syrup supply line discharges a syrup from a syrup tank under carbon-dioxide gas pressure and supplies the syrup via a syrup cooling coil, a syrup solenoid valve, a nozzle and connection tubes between the members. The chilled water supply line supplies chilled water from a water reservoir via a water cooling coil, a chilled water solenoid valve, the nozzle and connection tubes between the members.

A second aspect of the invention is a drink supply apparatus according to the first aspect, wherein the disposable drink container, the syrup solenoid valve, the chilled water solenoid valve, and the tubes between each of the solenoid valves and the nozzle are installed in a cooling chamber.

A third aspect of the invention is a drink supply apparatus according to the first aspect, wherein the disposable drink container, the syrup solenoid valve, the chilled water solenoid valve, the tubes between each of the solenoid valves and the nozzle, and a nozzle chamber are installed in a cooling chamber.

A fourth aspect of the invention is a drink supply apparatus that houses in a single space a first drink supply system that supplies drinks and is formed of a disposable drink container, a pump for discharging a specified amount of a drink from the disposable drink container and a drink solenoid valve; and a second drink supply system formed of a syrup supply line, a chilled water supply line and a carbonated water supply line. The syrup supply line discharges a syrup from a syrup tank under carbon-dioxide gas pressure and supplies the syrup via a syrup cooling coil, a syrup solenoid valve, a nozzle and connection tubes between the members. The chilled water supply line supplies chilled water from a water reservoir via a water cooling coil, a chilled water solenoid valve, the nozzle and connection tubes between the members. The carbonated water supply line supplies carbonated water via a carbonated water solenoid valve, the nozzle and connection tubes between the members, wherein the carbonated water is made in a carbonator to which water and carbon dioxide gas are supplied.

A fifth aspect of the invention is a drink supply apparatus according to the fourth aspect, wherein the disposable drink container, the syrup solenoid valve, the chilled water solenoid valve, the carbonated water solenoid valve, and the tubes between each of the solenoid valves and the nozzle are installed in a cooling chamber.

A sixth aspect of the invention is a drink supply apparatus according to the fourth aspect, wherein the disposable drink container, the syrup solenoid valve, the chilled water solenoid valve, the carbonated water solenoid valve, the tubes between each of the solenoid valves and the nozzle, and a nozzle chamber are installed in a cooling chamber.

According to the invention, the first drink supply system that supplies drinks from the disposable drink container, and the second drink supply system that supplies drinks from the syrup tank are accommodated in a single vending machine.

The syrup solenoid valve, the chilled water solenoid valve, and the tubes connected thereto are installed within the cooling chamber.

DETAILED DESCRIPTION OF PREFERRED EMBODIMENTS

Figure 1:
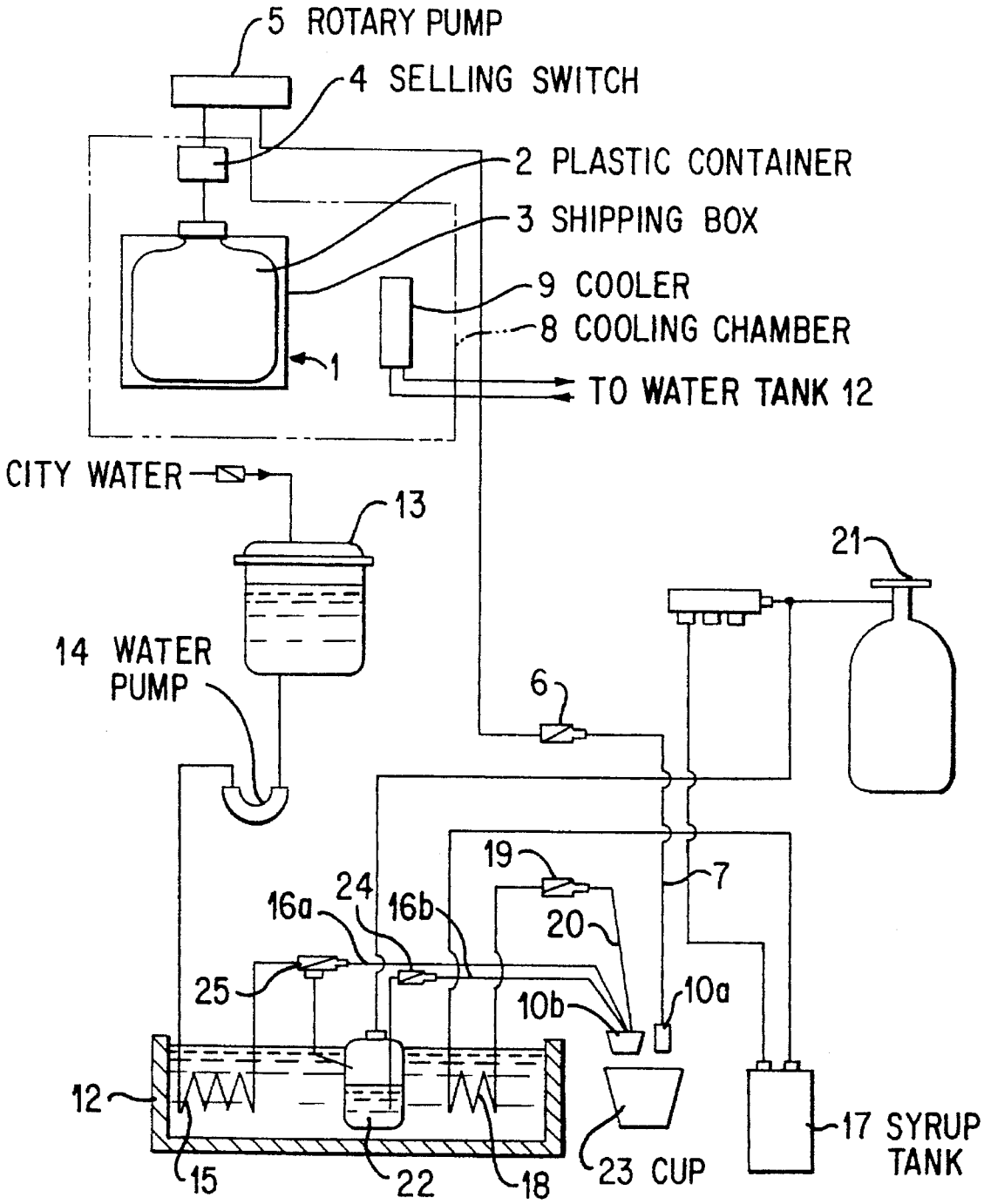
FIG. 1 is a block diagram of one embodiment of the invention.
Figure 7:
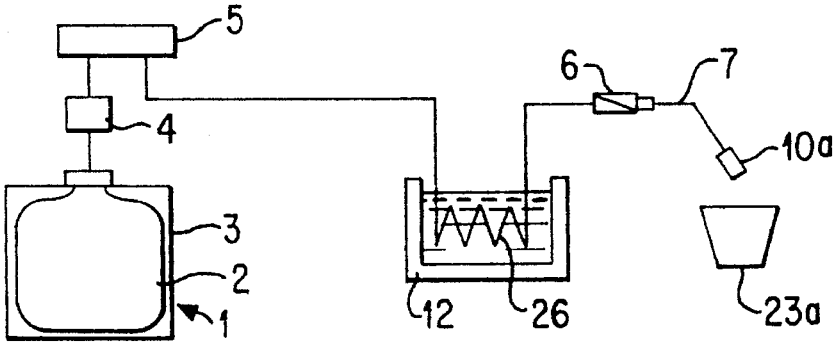
FIG. 7 PRIOR ART
FIG. 7 is a block diagram of a conventional drink supply apparatus that supplies drinks from a disposable drink container.
Figure 8:
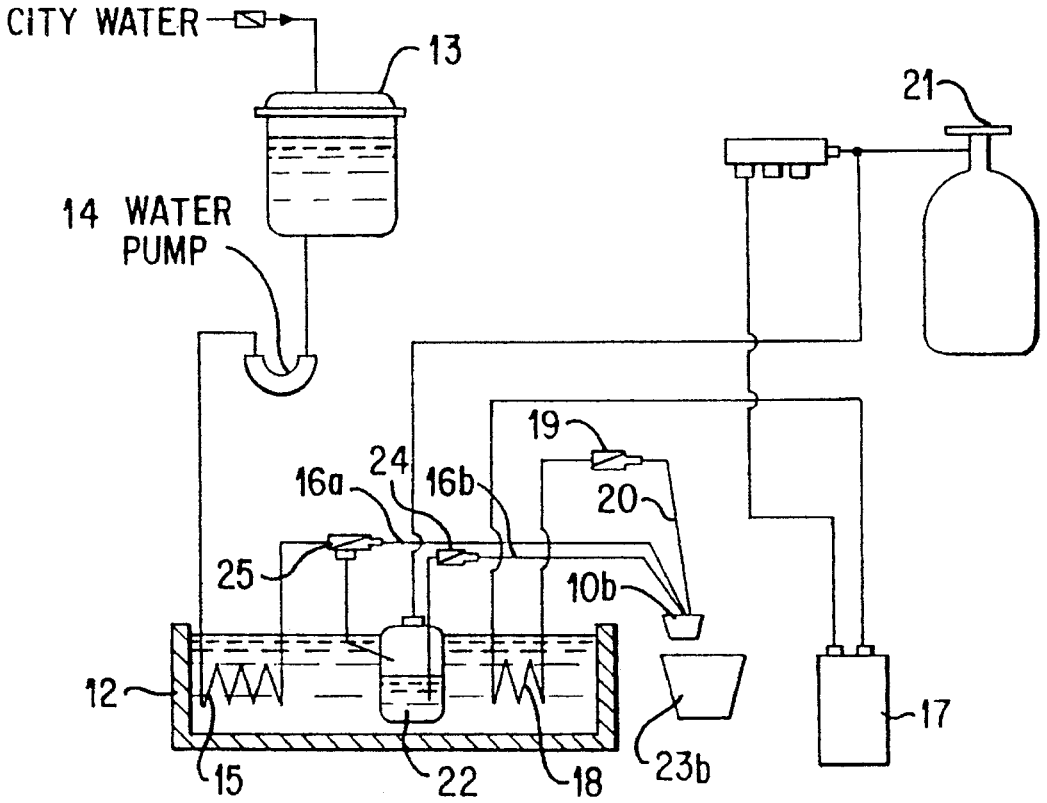
FIG. 8 PRIOR ART
FIG. 8 is a block diagram of a conventional drink supply apparatus that supplies drinks from a syrup tank.

FIG. 1 is a block diagram showing one embodiment of the invention. In this figure, the components with the same reference numerals as in FIGS. 7 and 8, which show a conventional drink supply apparatus, have the same functions as the corresponding components in these figures.

In this embodiment shown in FIG. 1, a first drink supply system comprises a rotary pump 5 that discharges a specified amount of a drink from a disposable container 1, a drink solenoid valve 6, and a nozzle 10*a*.

A second drink supply system comprises a syrup supply line, a chilled water supply line and a carbonated water supply line. The syrup supply line is formed of a syrup tank 17, a carbon-dioxide gas cylinder 21, a syrup-cooling coil 18, a syrup solenoid valve 19, a tube 20 connected thereto and a nozzle 10*b*. The chilled water supply line is formed of a water reservoir 13, a water pump 14, a water cooling coil 15, a chilled water three-way solenoid valve 25 and a tube 16*a*. The carbonated water supply line that supplies carbonated water is formed of the chilled water three-way solenoid valve 25, a carbonator 22, a carbonated water solenoid valve 24 and a tube 16*b*.

The first and the second drink supply systems are housed in a single automatic vending machine or dispenser. Reference numeral 23 designated a cup.

In the embodiment shown in FIG. 1, a disposable drink container 1 and a drink selling switch 4 are housed in a cooling chamber 8 cooled by a cooler 9.

The syrup tank 17, syrup cooling coil 18, syrup solenoid valve 19 and tube 20 are provided for each type of a syrup, though all of them are not shown. Even for a single type of a drink, more than one drink containers 1 and various selling switches 4 may be housed in the cooling chamber 8, and the selling switches 4 are operated by a selector valve (not shown).

Furthermore, various types of drink containers may be housed in the cooling chamber 8. No matter if two or more drink containers of the same type or different types are used, selling switches are provided for each of the drink containers, and rotary pumps are provided for each of the selector valves (not shown) or for each of the drink containers if the selector valves are not used.

Figure 2:
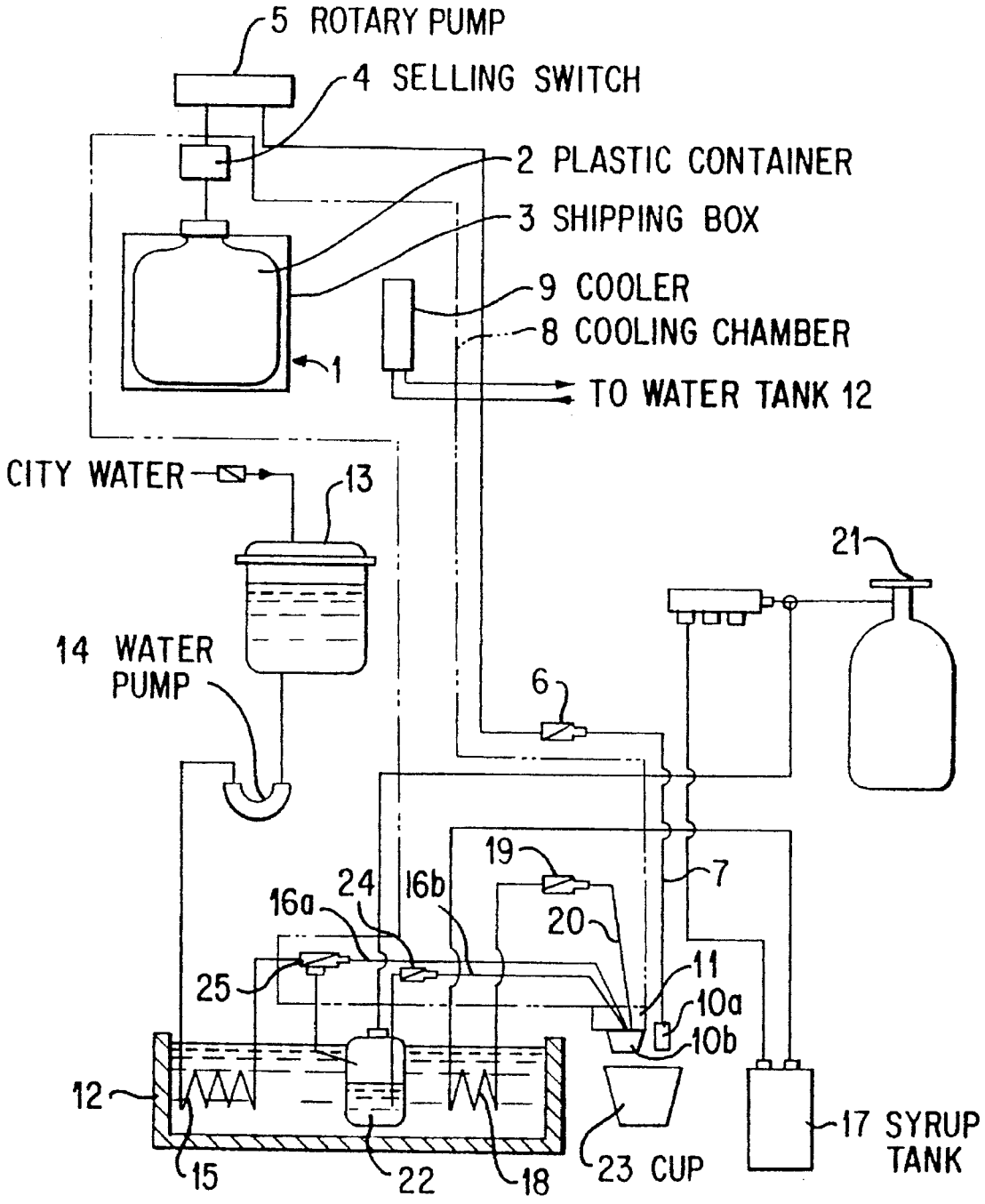
FIG. 2 is a block diagram of another embodiment of the invention.
Figure 3:
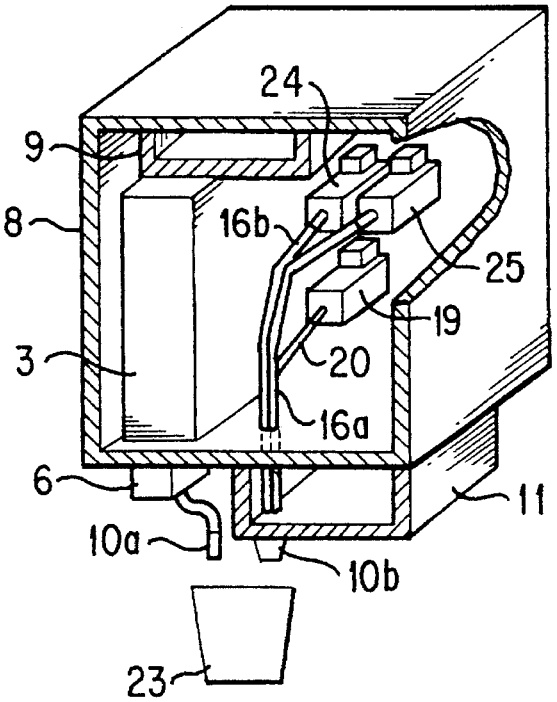
FIG. 3 is a partly cut perspective view of a main part of the embodiment.
Figure 4:
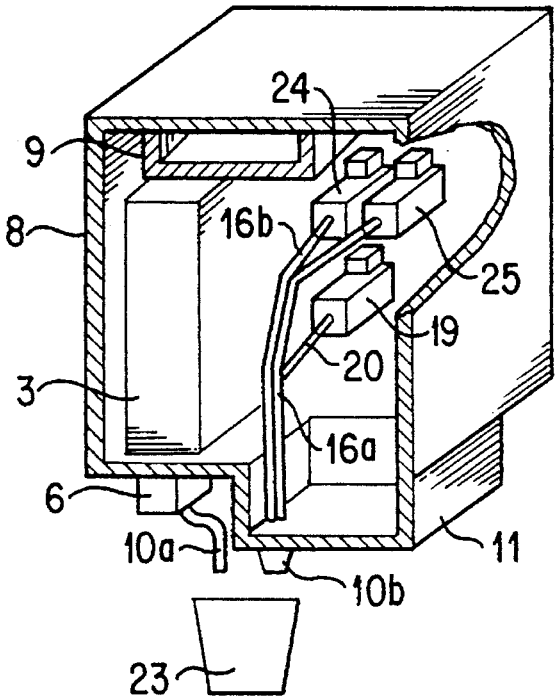
FIG. 4 is a partly cut perspective view of a main part of another example of the embodiment.

FIG. 2 is a block diagram showing another embodiment of the invention. FIGS. 3 and 4 are partly cut perspective views showing different examples of the main portions of the embodiment in FIG. 2.

In the embodiment shown in FIG. 2, in addition to a disposable container 1 and a drink sold-out switch 4, a syrup solenoid valve 19 and a tube 20 in the syrup supply line, a chilled water three-way solenoid valve 25 and a tube 16*a* in the chilled water line, and a carbonated water solenoid valve 24 and a tube 16*a* in the carbonated water line are installed in the cooling chamber 8, as shown in FIG. 3.

As in the embodiment in FIG. 1, the first and second drink supply systems of the embodiment in FIG. 2 are housed in a single automatic vending machine or dispenser.

The embodiment shown in FIG. 4 differs from the embodiment shown in FIG. 3 in that a nozzle chamber 11 is also installed in the cooling chamber 8.

Thus, in the embodiment shown in FIG. 4, in addition to the disposable container 1 and the drink selling switch 4, the syrup solenoid valve 19 and the tube 20 in the syrup supply line, the chilled water three-way solenoid vale 25 and the tube 16*a* in the chilled water line, the carbonated water solenoid valve 24 and the tube 16*b* in the carbonated water line, and a nozzle chamber 11 are installed in the cooling chamber 8.

Figure 5:
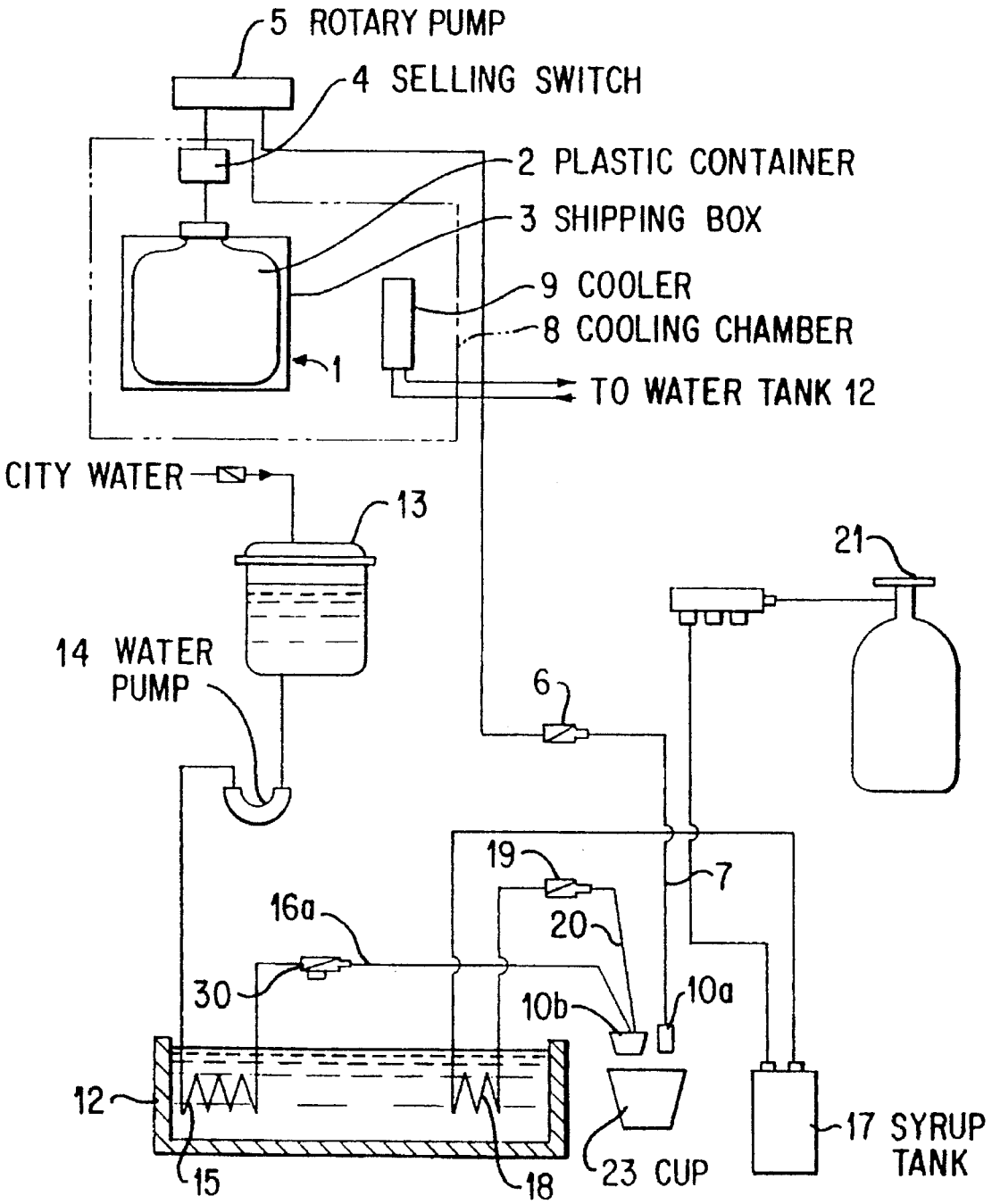
FIG. 5 is a block diagram of still another embodiment of the invention.

FIG. 5 is a block diagram showing still another embodiment of the embodiment. This embodiment, which is shown in FIG. 5 corresponds to the embodiment shown in FIG. 1 except that the carbonator 22 and carbonated water solenoid valve 24 are not provided in the embodiment in FIG. 5.

The second drink supply system of this embodiment, thus, comprises a syrup supply line and a chilled water supply line. The syrup supply line is formed of a syrup tank 17, carbon-dioxide gas cylinder 21, syrup cooling coil 18, syrup solenoid valve 19, tube 20 connected thereto and nozzle 10*b*. The chilled water supply line is formed of a water reservoir 13, water pump 14, water cooling coil 15, chilled water solenoid valve 30 and tube 16*a*.

In the embodiment shown in FIG. 5, the disposable drink container 1 and drink selling switch 4 are also housed in a cooling chamber 8 cooled by the cooler 9. The first and second drink supply systems of the embodiment shown in FIG. 5 are also housed in a single automatic vending machine or dispenser.

Figure 6:
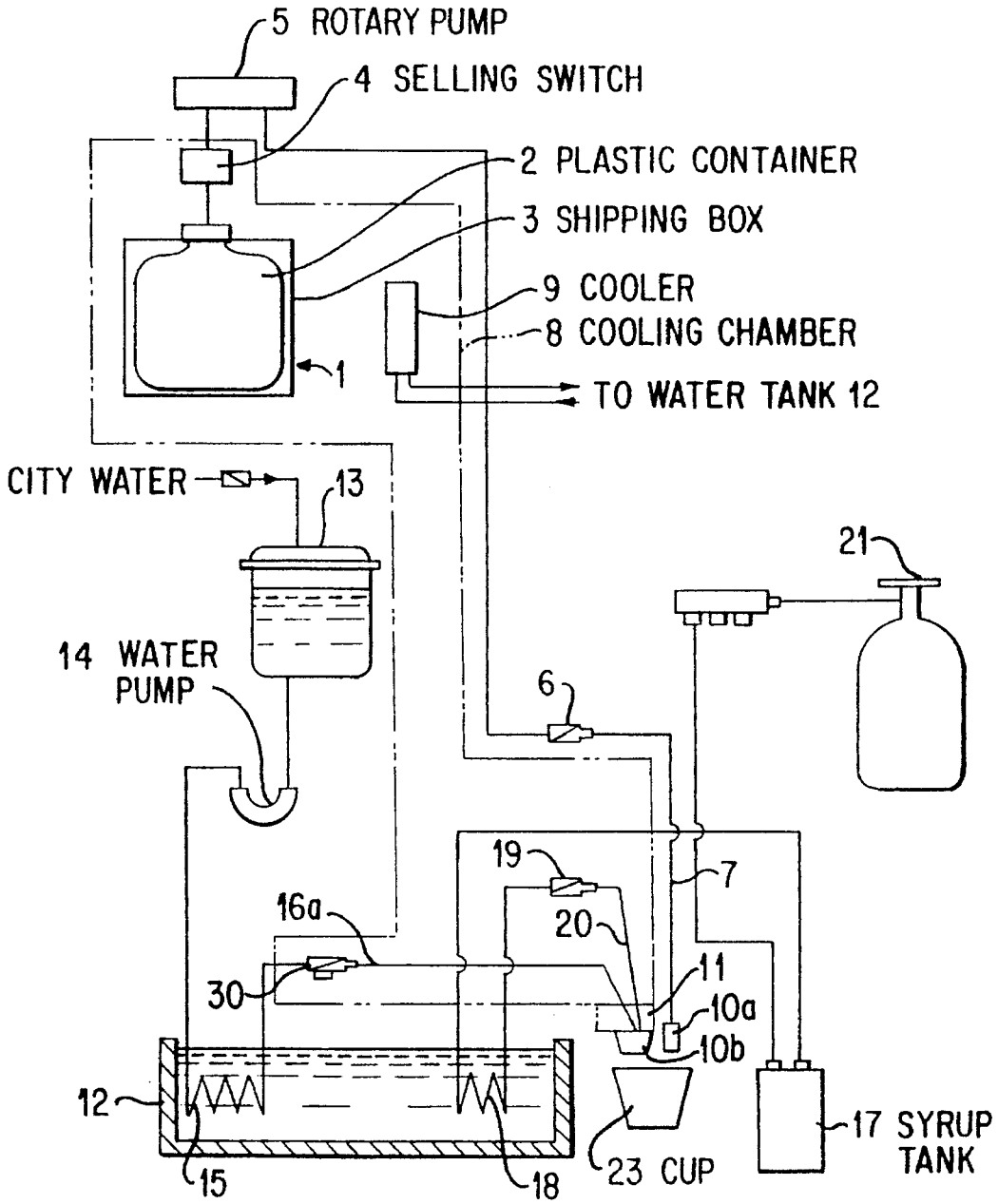
FIG. 6 is a block diagram of still another embodiment of the invention.

FIG. 6 is a block diagram showing a still further embodiment of the invention. The embodiment shown in FIG. 6 corresponds to the embodiment shown in FIG. 2 except that the carbonator 22 and carbonated water solenoid valve 24 are not provided in the embodiment in FIG. 6.

Thus, the second drink supply system of this embodiment also comprises a syrup supply line and a chilled water supply line. The syrup supply line is formed of a syrup tank 17, carbon-dioxide gas cylinder 21, syrup cooling coil 18, syrup solenoid valve 19, tube 20 connected thereto and nozzle 10*b*. The chilled water supply line is formed of a water reservoir 13, water pump 14, water cooling coil 15, chilled water solenoid valve 30 and tube 16*a*.

In the embodiment shown in FIG. 6, the disposable drink container 1, the drink selling switch 4, the syrup solenoid valve 19 and the tube 20 in the syrup supply line, and the chilled water solenoid valve 30 and the tube 16*a* in the chilled water line are installed in the cooling chamber, as shown in the figure.

The embodiment shown in FIG. 6 may also have a nozzle chamber 11 housed in the cooling chamber 8, as shown in FIG. 4. Also, as in the embodiment in FIG. 2, the first and the second drink supply systems of the embodiment in FIG. 6 are housed in a single automatic vending machine or dispenser.

In the invention, the first drink supply system that supplies drinks from the disposable container and the second drink supply system that supplies drinks from the syrup tank are housed in the single vending machine. Thus, it is possible to share a coin mechanism, cup supply mechanism, city water tap, and cup outlet port, which would otherwise have to be provided for each system, thereby reducing a required installation space.

Installation costs can also be reduced because the two systems in this invention share the same coin mechanism, cup supply mechanism, city water tap, and cup outlet port, which would otherwise have to be provided for each system.

Also, in the invention, the disposable container, the syrup solenoid valve, the chilled water solenoid valve, and the tubes between each of the solenoid valves and the nozzle are installed in the cooling chamber to maintain the syrup at an appropriate temperature. Thus, the syrup at that appropriate temperature is ejected, and it is possible to prevent the dripping of the syrup due to its expansion as well as its deterioration due to air sucked into the syrup.

What is claimed is:

1. A drink supply apparatus comprising:

a first drink supply system for supplying drink and including a disposable drink container, a pump connected to the container for discharging a specified amount of the drink from the container, a drink solenoid valve connected to the pump, and a drink nozzle connected to the drink solenoid valve;

a second drink supply system including a syrup supply line for discharging a syrup, said syrup supply line having a syrup tank for containing the syrup, a gas supply device connected to the syrup tank for ejecting the syrup under gas pressure in the gas supply device, a syrup cooling coil connected to the syrup tank, a syrup solenoid valve connected to the syrup cooling coil, and a syrup nozzle connected to the syrup solenoid valve for ejecting the syrup; and a chilled water supply line for supplying chilled water, said chilled water supply line having a water reservoir, a water cooling coil connected to the water reservoir, a chilled water solenoid valve connected to the water cooling coil, and a chilled water nozzle connected to the chilled water solenoid valve for electing water; and a housing for retaining the first and second drink supply systems therein.

2. A drink supply apparatus according to claim 1, wherein said housing further includes a cooling chamber; said syrup supply line further includes a syrup tube between the syrup nozzle and the syrup solenoid valve; said chilled water supply line further includes a chilled water tube situated between the chilled water nozzle and the chilled water solenoid valve; said disposable drink container, the syrup solenoid valve, the chilled water solenoid valve, the syrup supply tube and the chilled water tube are installed in the cooling chamber.

3. A drink supply apparatus according to claim 2, wherein said housing further includes a nozzle chamber disposed in the cooling chamber.

4. A drink supply apparatus according to claim 1, wherein said syrup nozzle and the chilled water nozzle are combined together to form one combination nozzle.

5. A drink supply apparatus according to claim 1, wherein said second drink supply system further includes a carbonated water supply line for supplying carbonated water and including a carbonator connected to the gas supply device and the chilled water supply line, said carbonator receiving carbon dioxide gas and water to form carbonated water, and a carbonated water solenoid valve connected between a carbonated water nozzle and the carbonator.

6. A drink supply apparatus according to claim 5, wherein said housing further includes a cooling chamber; said syrup supply line further includes a syrup tube between the syrup nozzle and the syrup solenoid valve; said chilled water supply line further includes a chilled water tube situated between the chilled water nozzle and the chilled water solenoid valve; said carbonated water supply line further includes a carbonated water tube situated between the carbonated water nozzle and the carbonated water solenoid valve; said disposable drink container, the syrup solenoid valve, the chilled water solenoid valve, the syrup supply tube, the chilled water tube, carbonated water solenoid valve and the carbonated water tube are installed in the cooling chamber.

7. A drink supply apparatus according to claim 6, wherein said housing further includes a nozzle chamber disposed in the cooling chamber.

* * * * *

UNITED STATES PATENT AND TRADEMARK OFFICE

CERTIFICATE OF CORRECTION

PATENT NO. : 5,556,006

DATED : September 17, 1996

INVENTOR(S) : Shigeki Sano

It is certified that error appears in the above-indentified patent and that said Letters Patent is hereby corrected as shown below:

Abstract, line 5, change "include" to --includes--.

Column 2, line 3, change "thank" to --tank--.

Column 4, line 5, change "designated" to --designates-- and first occurrence line 49, change "embodiment" to --invention--.

Column 6, line 12, change "electing" to --ejecting--.

Signed and Sealed this

Twenty-sixth Day of November 1996

*Attest:*

Bruce Lehman

BRUCE LEHMAN

*Attesting Officer*

*Commissioner of Patents and Trademarks*